US008464871B2

(12) United States Patent
Wnek

(10) Patent No.: US 8,464,871 B2
(45) Date of Patent: Jun. 18, 2013

(54) BLANK AND FORMING TOOL FOR FORMING A CONTAINER

(75) Inventor: Patrick H. Wnek, Sherwood, WI (US)

(73) Assignee: Graphic Packaging International, Inc., Marietta, GA (US)

( * ) Notice: Subject to any disclaimer, the term of this patent is extended or adjusted under 35 U.S.C. 154(b) by 353 days.

(21) Appl. No.: 12/881,632

(22) Filed: Sep. 14, 2010

(65) Prior Publication Data

US 2011/0062050 A1 Mar. 17, 2011

Related U.S. Application Data

(60) Provisional application No. 61/242,145, filed on Sep. 14, 2009.

(51) Int. Cl.
*B65D 1/34* (2006.01)

(52) U.S. Cl.
USPC ..... 206/557; 229/407; 229/902; 220/574

(58) Field of Classification Search
USPC ..... 206/557, 784; 229/406, 407, 902, 229/904, 906; 220/574
See application file for complete search history.

(56) References Cited

U.S. PATENT DOCUMENTS

| | | | | |
|---|---|---|---|---|
| 1,022,882 | A | | 4/1912 | Schwenn |
| 2,522,397 | A | | 9/1950 | Palmer |
| 2,634,880 | A | | 4/1953 | Gravatt |
| 2,997,927 | A | | 8/1961 | Carson |
| 3,033,434 | A | | 5/1962 | Carson |
| 3,099,377 | A | | 7/1963 | Metzler et al. |
| 3,195,770 | A | | 7/1965 | Robertson |
| 3,220,631 | A | | 11/1965 | Reifers |
| 3,229,886 | A | | 1/1966 | Grogel |
| 3,286,876 | A | | 11/1966 | Ring |
| 3,530,917 | A | | 9/1970 | Donavan |
| 3,669,305 | A | | 6/1972 | Kinney et al. |
| 3,680,733 | A | | 8/1972 | Winslow |
| 3,684,633 | A | | 8/1972 | Haase |
| 3,850,340 | A | | 11/1974 | Siemonsen et al. |
| 3,968,921 | A | | 7/1976 | Jewell |
| 4,026,458 | A | * | 5/1977 | Morris et al. ..... 229/182.1 |
| 4,051,707 | A | | 10/1977 | Valek et al. |
| 4,096,947 | A | | 6/1978 | Morse |

(Continued)

FOREIGN PATENT DOCUMENTS

| | | |
|---|---|---|
| DE | 509 065 | 4/1969 |
| DE | 80 11 020 | 9/1980 |

(Continued)

OTHER PUBLICATIONS

International Search Report and Written Opinion for PCT/US2010/048741, mailed May 18, 2011.

(Continued)

*Primary Examiner* — Jacob K Ackun
(74) *Attorney, Agent, or Firm* — Womble Carlyle Sandridge & Rice, LLP

(57) ABSTRACT

A blank for being formed into a container. The blank has a marginal area that includes a plurality of score lines for facilitating forming of the blank into the container. The score lines are positioned to facilitate formation of the container. A forming tool has features to facilitate forming the blank into the container.

11 Claims, 6 Drawing Sheets

U.S. PATENT DOCUMENTS

| | | | | |
|---|---|---|---|---|
| 4,139,115 | A | 2/1979 | Robinson | |
| 4,183,435 | A | 1/1980 | Thompson et al. | |
| 4,202,464 | A | 5/1980 | Mohs et al. | |
| 4,284,023 | A * | 8/1981 | Murayama | 413/14 |
| 4,606,496 | A | 8/1986 | Marx et al. | |
| 4,609,140 | A | 9/1986 | Van Handel et al. | |
| 4,704,510 | A | 11/1987 | Matsui | |
| 4,721,499 | A | 1/1988 | Marx et al. | |
| 4,721,500 | A | 1/1988 | Van Handel et al. | |
| 4,775,771 | A | 10/1988 | Pawlowski et al. | |
| 4,832,676 | A | 5/1989 | Johns et al. | |
| 4,865,921 | A | 9/1989 | Hollenberg et al. | |
| 4,890,439 | A | 1/1990 | Smart | |
| 4,935,089 | A | 6/1990 | Schirmer | |
| 4,936,935 | A | 6/1990 | Beckett | |
| 4,963,424 | A | 10/1990 | Beckett | |
| 4,967,908 | A | 11/1990 | Kessler | |
| 5,039,364 | A | 8/1991 | Beckett et al. | |
| 5,117,078 | A | 5/1992 | Beckett | |
| 5,190,209 | A | 3/1993 | Gordon et al. | |
| 5,213,902 | A | 5/1993 | Beckett | |
| 5,221,419 | A | 6/1993 | Beckett | |
| 5,260,537 | A | 11/1993 | Beckett | |
| 5,266,386 | A | 11/1993 | Beckett | |
| 5,269,717 | A | 12/1993 | Tardif | |
| RE34,683 | E | 8/1994 | Maynard et al. | |
| 5,340,436 | A | 8/1994 | Beckett | |
| 5,354,973 | A | 10/1994 | Beckett | |
| 5,410,135 | A | 4/1995 | Pollart et al. | |
| 5,424,517 | A | 6/1995 | Habeger, Jr. et al. | |
| 5,519,195 | A | 5/1996 | Keefer et al. | |
| 5,617,972 | A | 4/1997 | Morano et al. | |
| 5,628,921 | A | 5/1997 | Beckett | |
| 5,672,407 | A | 9/1997 | Beckett | |
| 5,758,773 | A | 6/1998 | Clements | |
| 5,759,422 | A | 6/1998 | Schmelzer et al. | |
| 5,782,376 | A | 7/1998 | Brauner et al. | |
| 5,800,724 | A | 9/1998 | Habeger et al. | |
| 5,934,472 | A | 8/1999 | Ramirez et al. | |
| 5,938,112 | A | 8/1999 | Sandstrom | |
| 6,093,460 | A | 7/2000 | Iwaya | |
| 6,114,679 | A | 9/2000 | Lai et al. | |
| 6,150,646 | A | 11/2000 | Lai et al. | |
| 6,204,492 | B1 | 3/2001 | Zeng et al. | |
| 6,213,301 | B1 | 4/2001 | Landis et al. | |
| 6,251,451 | B1 | 6/2001 | Zeng | |
| 6,325,213 | B1 | 12/2001 | Landis, II | |
| 6,414,290 | B1 | 7/2002 | Cole et al. | |
| 6,415,945 | B1 | 7/2002 | Zank et al. | |
| 6,433,322 | B2 | 8/2002 | Zeng et al. | |
| 6,455,827 | B2 | 9/2002 | Zeng | |
| 6,552,315 | B2 | 4/2003 | Zeng et al. | |
| 6,568,534 | B2 | 5/2003 | Zank | |
| 6,677,563 | B2 | 1/2004 | Lai | |
| 6,717,121 | B2 | 4/2004 | Zeng et al. | |
| 6,765,182 | B2 | 7/2004 | Cole et al. | |
| 6,988,654 | B2 | 1/2006 | Wnek | |
| 7,337,943 | B2 * | 3/2008 | Johns et al. | 229/406 |
| 2002/0092791 | A1 | 7/2002 | Wnek | |
| 2002/0113118 | A1 * | 8/2002 | Littlejohn et al. | 229/407 |
| 2003/0205319 | A1 | 11/2003 | Bengtsson et al. | |
| 2004/0262322 | A1 | 12/2004 | Middleton et al. | |
| 2005/0109653 | A1 | 5/2005 | Wnek et al. | |
| 2006/0198972 | A1 | 9/2006 | Ueda et al. | |
| 2007/0081743 | A1 | 4/2007 | Kim | |
| 2007/0267374 | A1 | 11/2007 | Middleton et al. | |
| 2009/0173776 | A1 * | 7/2009 | Swoboda et al. | 229/407 |
| 2009/0223952 | A1 | 9/2009 | Wnek et al. | |

FOREIGN PATENT DOCUMENTS

| | | | |
|---|---|---|---|
| DE | 87 13 290.7 | | 1/1988 |
| DE | 37 37 052 | A1 | 5/1989 |
| DE | 296 02 348 | U1 | 5/1996 |
| DE | 101 49 143 | A1 | 4/2003 |
| EP | 0 082 209 | | 6/1983 |
| EP | 1 332 972 | | 8/2003 |
| FR | 2 266 638 | | 10/1975 |
| FR | 2 599 002 | | 11/1987 |
| FR | 2 733 715 | | 11/1996 |
| GB | 1 264 484 | | 2/1972 |
| GB | 1 348 370 | | 3/1974 |
| GB | 1 376 603 | | 12/1974 |
| GB | 2 171 048 | | 8/1986 |
| JP | 47-23456 | | 10/1972 |
| JP | 54-116059 | | 9/1979 |
| JP | 54-126887 | | 10/1979 |
| JP | 56065866 | U | 6/1981 |
| JP | 59-75004 | | 4/1984 |
| JP | 03-004582 | | 1/1991 |
| JP | 3057020 | U | 5/1991 |
| JP | 6000843 | | 1/1994 |
| JP | 60-96234 | | 4/1994 |
| JP | 07-28883 | | 1/1995 |
| JP | 08-156944 | | 6/1996 |
| JP | 3031361 | | 9/1996 |
| JP | 8-337234 | | 12/1996 |
| JP | 08-337235 | | 12/1996 |
| JP | 09-254948 | | 9/1997 |
| JP | 2000-043840 | | 2/2000 |
| JP | 2000-142825 | | 5/2000 |
| JP | 2000-238760 | | 9/2000 |
| JP | 2000-335550 | | 12/2000 |
| JP | 2000-517260 | | 12/2000 |
| JP | 2001-213420 | | 8/2001 |
| JP | 2001-328617 | | 11/2001 |
| WO | WO 96-11142 | | 4/1996 |
| WO | WO 98-09812 | | 3/1998 |
| WO | WO 03/066435 | | 8/2003 |
| WO | WO 03/078012 | | 9/2003 |
| WO | WO 2004-033324 | | 4/2004 |
| WO | WO 2008-049048 | | 4/2008 |
| WO | WO 2009-086501 | | 7/2009 |
| WO | WO 2009-088904 | | 7/2009 |

OTHER PUBLICATIONS

EP 03 77 6279—Suplementary European Search Report.
PCT/US2007/081743 International Search Report & Written Opinion.

* cited by examiner

BLANK AND FORMING TOOL FOR FORMING A CONTAINER

CROSS-REFERENCE TO RELATED APPLICATIONS

This application claims the benefit of U.S. Provisional Patent Application No. 61/242,145, filed Sep. 14, 2009.

INCORPORATION BY REFERENCE

U.S. Provisional Patent Application No. 61/242,145, which was filed on Aug. 26, 2009, is hereby incorporated by reference for all purposes as if presented herein in its entirety.

BACKGROUND OF THE DISCLOSURE

The present disclosure relates to blanks, containers, trays, constructs, forming tools and various features to facilitate forming a container from a blank.

SUMMARY OF THE DISCLOSURE

In one aspect, the disclosure is generally directed to a blank for being formed into a container. The blank has a marginal area that includes a plurality of score lines for facilitating forming of the blank into the container. The score lines are positioned to facilitate formation of the container.

In another aspect, the disclosure is generally directed to a container formed from a blank. The container includes features that are formed by a plurality of score lines in a marginal portion of the blank.

In another aspect, the disclosure is generally directed to a forming tool for forming a container from a blank. The forming tool comprises a forming cavity for receiving the blank and a punch for being at least partially received in the cavity to form the blank into the container. The cavity has features to facilitate forming the container from the blank.

In another aspect, the disclosure is generally directed to a blank for forming a container. The blank comprises a central portion, an outer edge, and a marginal portion between the outer edge and the central portion. The blank comprises a radius extending from a center of the blank to the outer edge. The marginal portion comprises a plurality of radial score lines having an angular spacing between respective adjacent radial score lines. The plurality of score lines comprises at least one first score line and at least one second score line. The at least one first score line has a first length and the least one second score line has a second length. The first length being less than the second length.

In another aspect, the disclosure is generally directed to a tool for forming a container from a blank. The tool comprises a first tool assembly and a second tool assembly. At least one of the first tool assembly and the second tool assembly is moveable between an open position wherein the blank is received between the first and the second tool assembly and a closed position wherein the blank is formed into the container. At least one of the first and the second tool assembly has a curved surface for forming a transition between a flange of the container formed from the blank and a side wall of the container formed from the blank.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure relates generally to various aspects of containers, constructs, trays, materials, packages, elements, and articles, and methods of making such containers, constructs, trays, materials, packages, elements, and articles. Although several different aspects, implementations, and embodiments are disclosed, numerous interrelationships between, combinations thereof, and modifications of the various aspects, implementations, and embodiments are contemplated hereby. In one illustrated embodiment, the present disclosure relates to forming a container or tray for holding food items or various other articles. However, in other embodiments, the container or tray can be used to form other non-food containing articles or may be used for heating or cooking.

Figure 8:
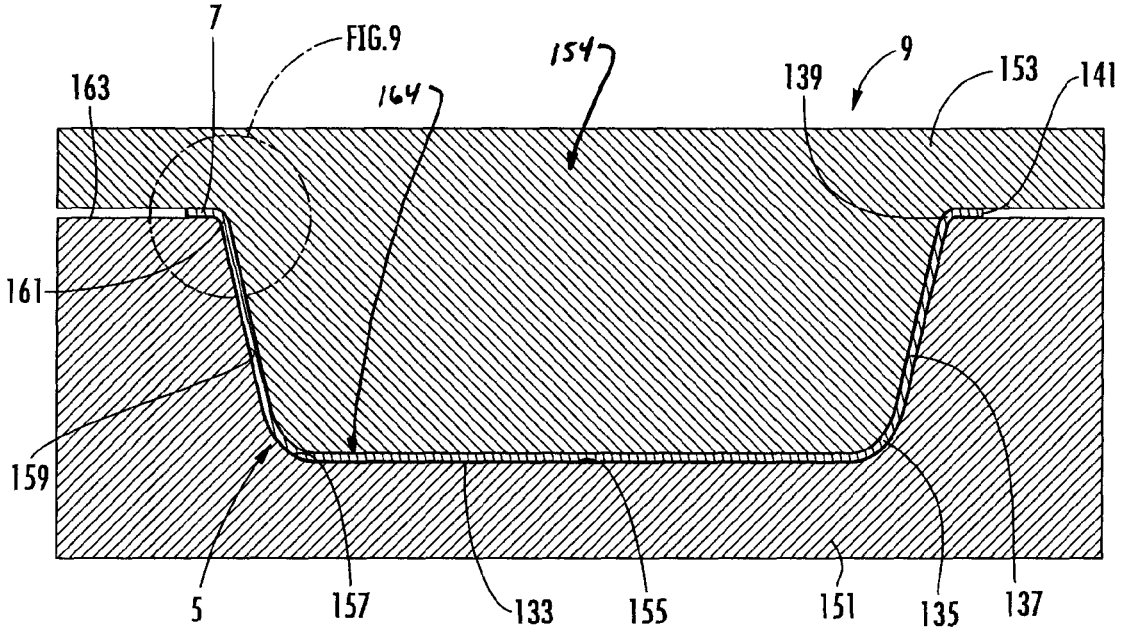
Figure 9:
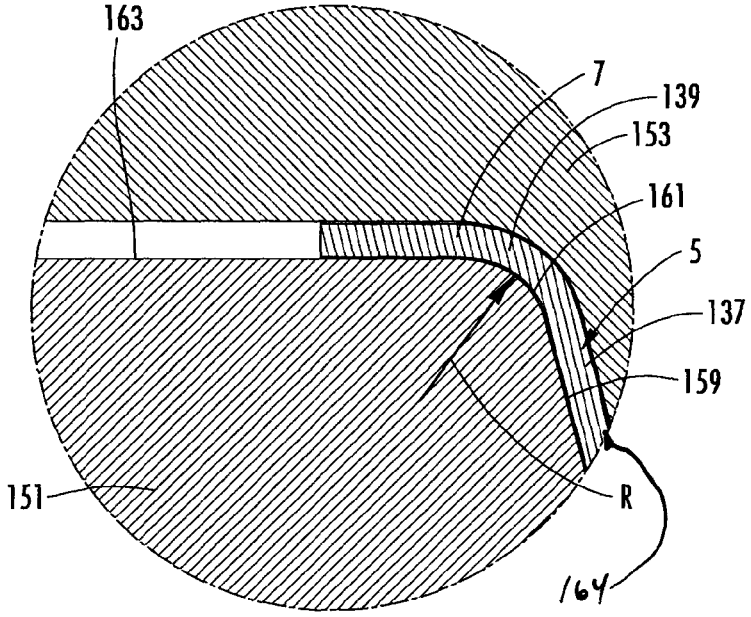

FIGS. 1-4 are a plan views of a blank 3 of various embodiments (indicated 3A-3D) that are used to form a container 5 (FIGS. 5-7) having a flange 7. In the illustrated embodiment, each of the blanks 3 is generally circular and is for being press formed into the container 5 that, in the illustrated embodiment, is a generally circular tray. It is understood that each blank 3 can be press-formed into the container 5 by a forming tool 9 (FIGS. 8 and 9). The forming tool 9 can be similar to and have similar features and/or components conventional forming tools such as are disclosed in U.S. Patent Application Publication No. 2005/0109653, the entire contents of which are incorporated herein by reference for all purposes. Also, the forming tool 9 can have similar features and components such as the forming tool disclosed in International Publication No. WO 2008/049048 ("the '048 publication"), the entire contents of which are incorporated by reference for all purposes, or any other suitable forming tool assembly. Also, the blanks 3 and the container 5 could be shapes other than circular (e.g., oval, rectangular, irregular, etc) without departing from the scope of this disclosure. The blanks 3 of the present disclosure have features that allow the container 5 made from each blank to have a flange 7 that is a substantially uniform width around the perimeter of the container.

The blanks 3 or container 5 can have denesting features such as any suitable denesting feature described in the '048 publication or in U.S. application Ser. No. 12/868,850, filed Aug. 26, 2010, the entire contents of which are incorporated by reference herein for all purposes.

Figure 1:
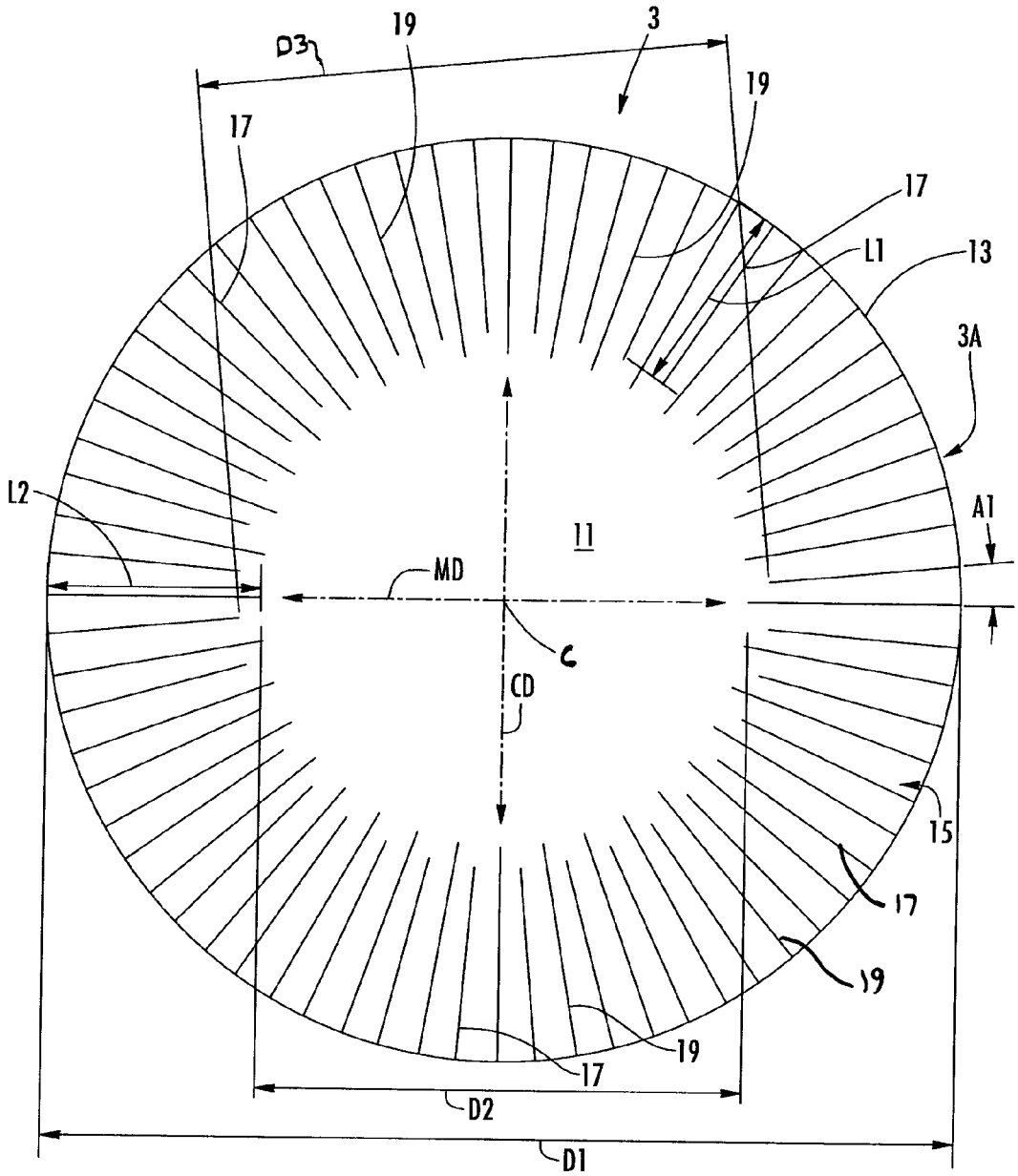
FIGS. 1-9 show various views of various features of a blank, container, and/or forming tool of various embodiments of the present disclosure.

As shown in FIG. 1, the blanks have a machine-direction (MD) or feed direction corresponding to the direction the blanks are conveyed as they are positioned in the tool, and a cross-direction (CD), that is generally perpendicular to the machine-direction. The blank 3A has a central portion 11, an outer edge 13, and a marginal portion 15 between the outer edge and the central portion. The blank 3 includes a lateral axis L1 and a longitudinal axis L2 that is generally perpendicular to the lateral axis.

In the first embodiment, the marginal portion 15 of the blank 3 includes a plurality of score lines 17, 19. The score lines 17, 19 are all positioned in the marginal portion 15 such that the score lines extend generally radially from the center C of the blank (e.g., the score lines would not intersect each other and would intersect the center of the blank if the score lines were extended past the marginal portion). The score lines 17 are shorter than the score lines 19. In one embodiment, adjacent score lines 17, 19 are spaced apart by an angle of at least approximately 5 degrees that is uniform around the perimeter of the blank. The central portion 11 can be substantially free of any fold lines, score line, or other line of weakening, without departing from the disclosure. Further, the central portion 11 can have a line of weakening to facilitate forming the blank 3 into the container 5 without departing from the disclosure.

All dimensional information presented herein is intended to be illustrative of certain aspects, features, etc., of various embodiments of the disclosure, and is not intended to limit the scope of the disclosure. The dimensions of the blanks, containers, forming tools, features, or any other dimension, can be more or less than what is shown and described in this disclosure without departing from the scope of this disclosure.

As shown in the first embodiment, the blank 3A has a diameter D1 of at least approximately 6.687 inches, the central portion 11 has a minimum diameter D2 between respective ends of the score lines 19 of at least approximately 3.590 and a maximum diameter D3 between respective ends of the score lines 17 of at least approximately 3.932 inches. In the embodiment of FIG. 1, the shorter score lines 17 have a length L1 of at least approximately 1.3775 inches and the longer score lines 19 have a length L2 of at least approximately 1.5485 inches, making the minimum radial length of the marginal portion 15 the length L1, and the maximum radial length of the marginal portion the length L2. In the embodiment of FIG. 1, the blank 3 has 72 score lines 17, 19, each respectively spaced apart by an angle A1 of approximately five degrees, but more or less than 72 score lines could be provided and the angle A1 could be more or less than five degrees.

In one embodiment, the score lines 19 are at least about 5 percent longer than the score lines 17, in another embodiment, the score lines 19 can be at least about 10 percent longer than the score lines 17, and in yet another embodiment, the score lines 19 can be at least about 12 percent longer than the score lines 17.

Figure 2:
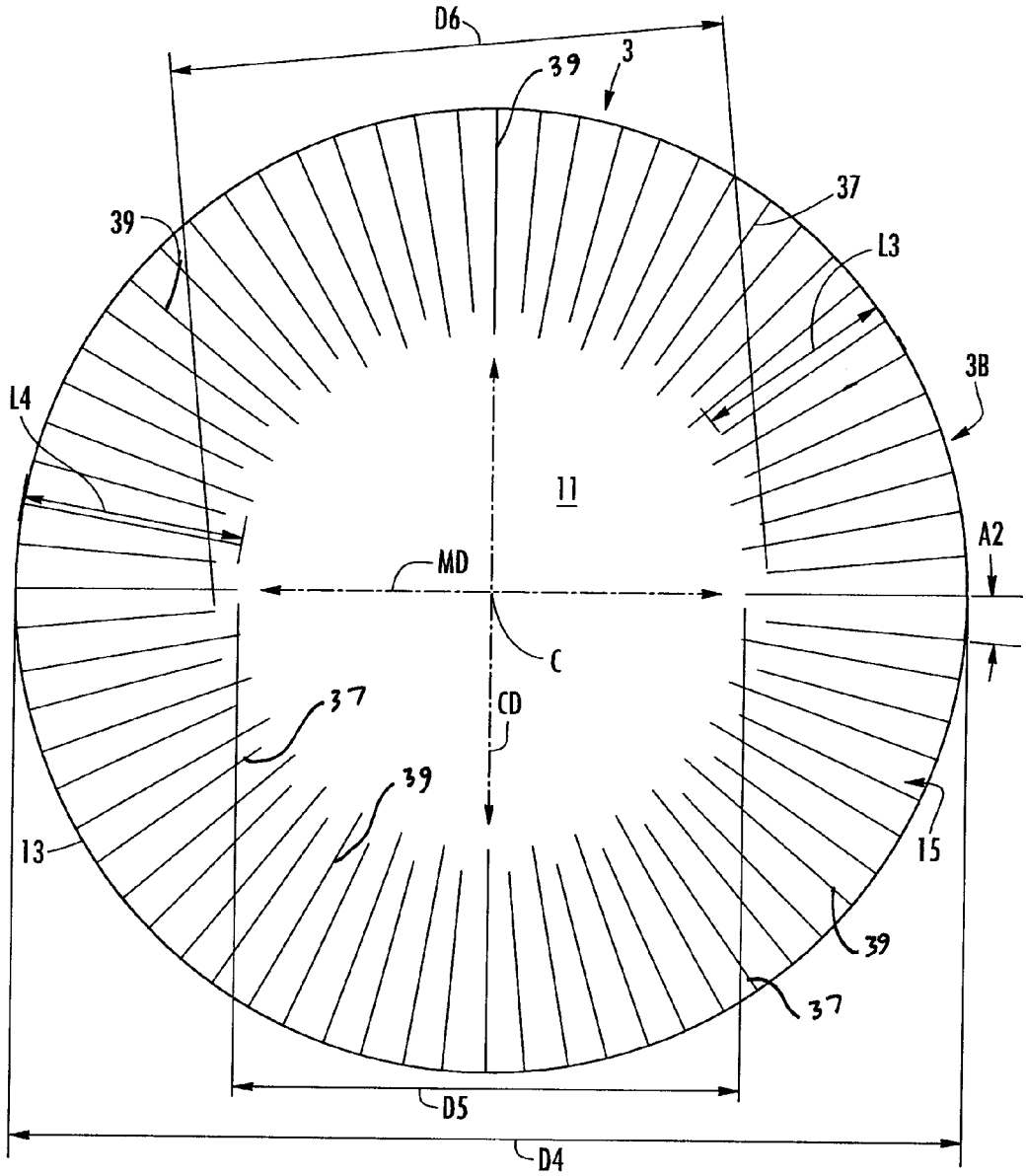

In the embodiment of FIG. 2, the blank 3B has a larger diameter D4 than the diameter D1 of blank 3A, the central portion 11 has a minimum diameter D5 that is the same as the minimum diameter D2 of the blank 3A, and the central portion has a maximum diameter D6 that is the same as the maximum diameter D3 of the blank 3A. The score lines 37, 39 of the blank 3B are longer than the score lines 17, 19 of the blank 3A. In the embodiment of FIG. 2, the blank 3B has a diameter D4 of at least approximately 6.937 inches, the score lines 37 have a length L3 of at least approximately 1.5025 inches, and the score lines 39 have a length L4 of at least approximately 1.6735 inches. The blank 3B includes 72 score lines 37, 39 at an equal 5 degree angular spacing A2 between adjacent score lines.

Figure 3:
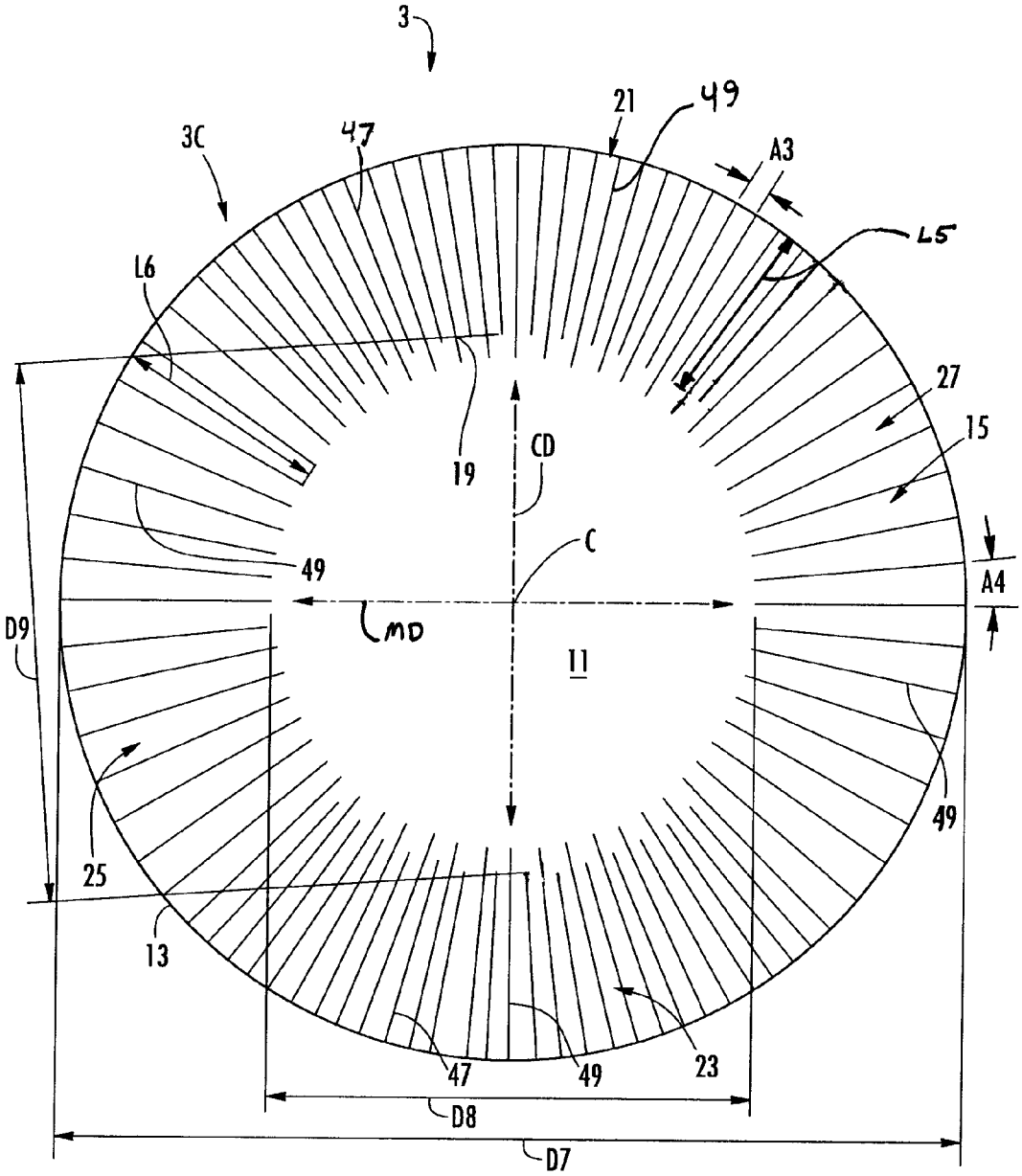

In the embodiment of FIG. 3, the blank 3C has a diameter D7 that is equal to the diameter D1 of the blank 3A, the central portion 11 has a minimum diameter D8 that is the same as the minimum diameter D2 of the blank 3A, and the central portion has a maximum diameter D9 that is the same as the maximum diameter D3 of the blank 3A. The marginal portion 15 of the blank 3C includes score lines 47, 49. The score lines 47, 49 have a respective length L5, L6 that is equal to the corresponding length L1, L2 of a respective score line 17, 19 of the blank 3A of the first embodiment. In the third embodiment, the blank 3C includes a greater number and different arrangement of the score lines 47, 49. The blank 3C has cross-direction portions 21, 23 of the marginal portion 15 at respective opposite sides of the blanks. The cross-direction portions 21, 23 each includes score lines 47, 49 that are more closely spaced than the previous embodiments. In the embodiment of FIG. 3, each cross-direction portion 21, 23 includes 29 score lines 47, 49 that are spaced apart at an equal 3.21 degree spacing A3 between adjacent score lines.

In the embodiment of FIG. 3, the blank 3C has machine-direction portions 25, 27 of the marginal portion 15 that includes the longer score lines 49 that are spaced apart a greater distance than the spacing of the previous embodiments. In one embodiment, the machine-direction portions 25, 29 are free from the shorter score lines 47. In the illustrated embodiment, the score lines 49 in the machine-direction portions 25, 27 of the blank 3C are spaced apart at an equal 5.71 degree spacing A4 between adjacent score lines. Each of the machine-direction portions 25, 27 includes 15 score lines 49 so that the blank 3C includes a total of 88 score lines (15 in each machine direction portion 25, 27 and 29 in each cross-direction portion 21, 23).

Figure 4:
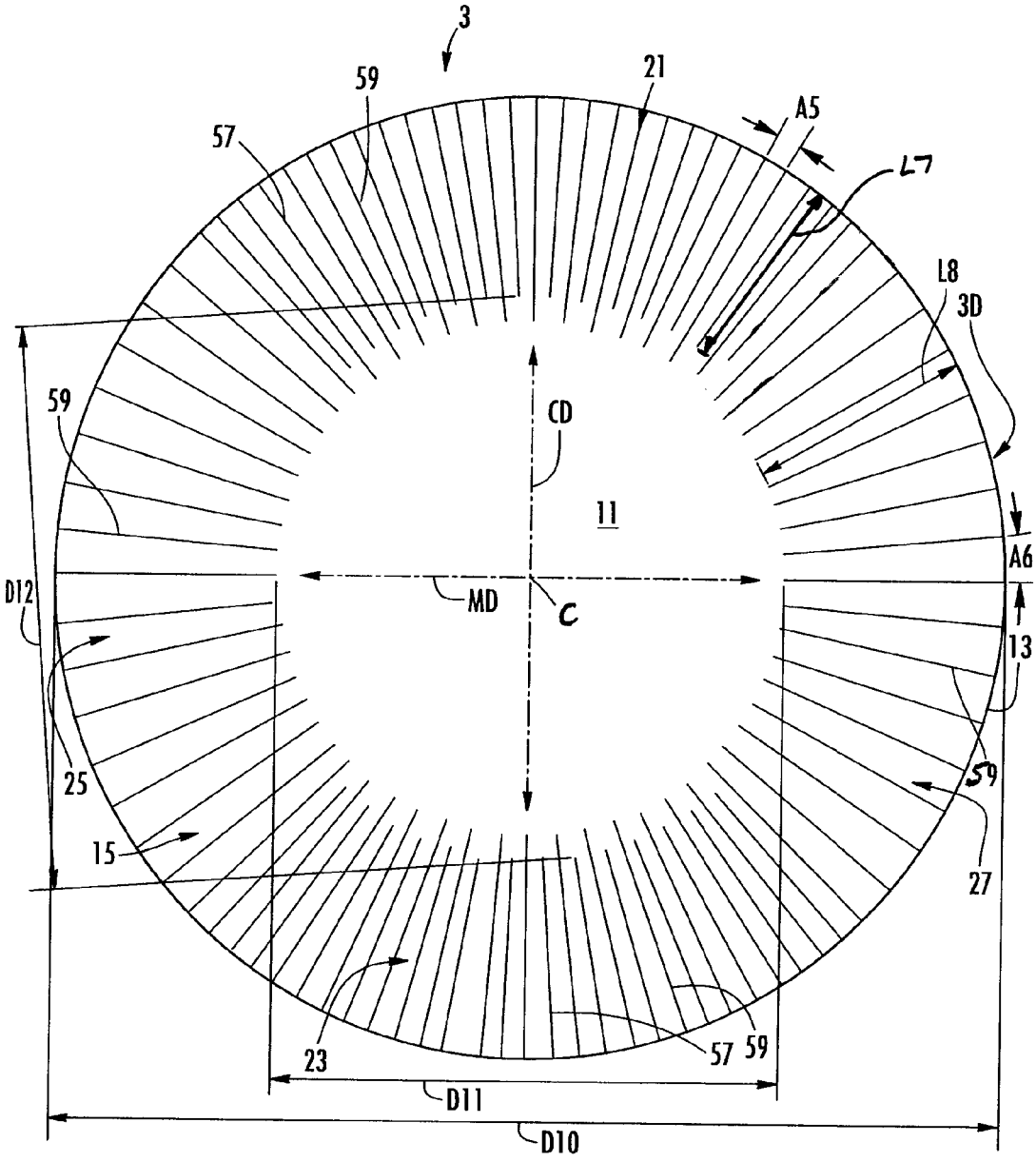

In the embodiment of FIG. 4, the blank 3D has a diameter D10 that is equal to the diameter D2 of the blank 3B of the second embodiment, and the score lines 57, 59 have respective lengths L7, L8 that are the same length as the length L3, L4 of the score lines 37, 39 of the blank 3B of the second embodiment. The central portion 11 has a minimum diameter D10 that is the same as minimum diameter D2 of the blank 3A, and the central portion has a maximum diameter D11 that is the same as the maximum diameter D3 of the blank 3A. The blank 3D has cross-direction portions 81, 83 and machine-direction portions 85, 87 that are similar to the portions 23, 23 and 25, 27 of the blank 3C of the third embodiment in that the cross-direction portions 81, 83 each include 29 score lines 57, 59, with an equal 3.21 degree spacing A5 between respective adjacent score lines. The machine-direction portions 85, 87 each include 15 score lines 79, with an equal 5.71 degree spacing A6 between respective adjacent score lines.

The score lines 17, 19, 37, 39, 47, 49, 57, 59 of the blanks 3A, 3B, 3C, 3D can be otherwise shaped, arranged, and/or configured without departing from the scope of this disclosure. In one embodiment, the blank 3 comprises 18 point paperboard having a thickness of approximately 0.018" (0.46 mm), but the blank 3 could have a larger or smaller thickness or could comprise other materials. All of the dimensional information presented herein is intended to be illustrative of certain aspects of the disclosure and is not intended to limit the scope of the disclosure, as various other embodiments of the disclosure could include dimensions that are greater than or less than the dimensions included herein.

Figure 5:
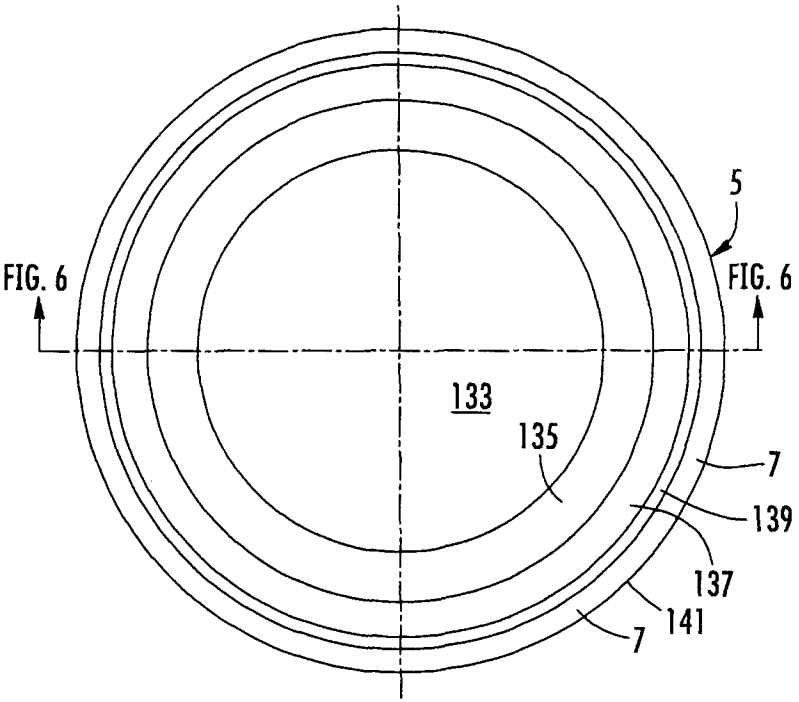
Figure 6:
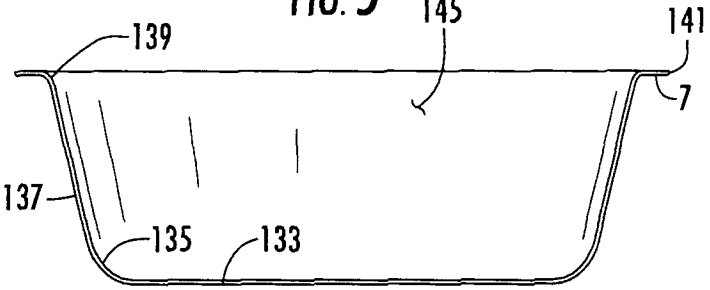
Figure 7:
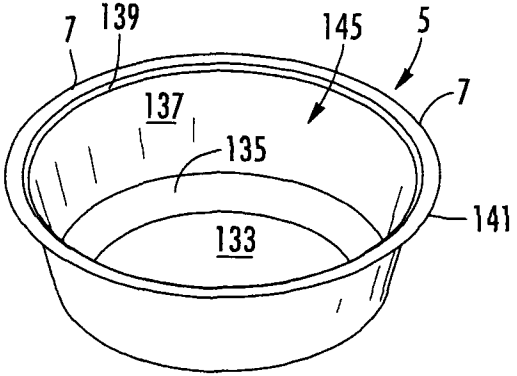

FIGS. 5-7 show various views of the container 5 formed from a respective one of the blanks 3. The container 5 comprises a generally flat bottom wall 133, a bottom corner 135 that connects the bottom wall to an annular side wall 137, an upper corner 139 that connects the side wall 137 to the flange 7, and an outer radial edge 141. The bottom wall 133 and side wall 137 at least partially define an interior space 145 of the container 5. The container 5 could be otherwise shaped, arrange, configured, and/or dimensioned without departing from this disclosure.

As shown in FIGS. 8 and 9, the forming tool 9 comprises a cavity block 151 that is part of a lower tool assembly 152, and a punch or nose 153 that is part of an upper tool assembly 154. The cavity block 151 has a bottom wall 155, a lower corner 157 that connects the bottom wall to an annular side wall 159, an upper corner 161 that connects the sidewall to an upper surface 163. The bottom wall 155, lower corner 157, annular side wall 159, upper corner 161 form a recess 164 in the cavity block 151 below the upper surface 163. The upper surface 163 supports the flange 7 when the punch 153 has been received into the recess 164 of the cavity block 151 to form the blank 3 into the container 5. The recess 164 and upper surface 163 of the cavity block 151 are generally shaped to correspond with the desired shape of the container 5.

The upper corner 161 is a rounded surface between the flat upper surface 163 and the flat side wall surface 159 that has an increased radius to minimize forces that occur when the blank 3 is pulled over the upper corner of the forming tool 9 during formation of the container 5 from the blank. The upper corner 161 forms the upper corner 139 of the container 5 that connects the flange 7 to the side wall 137. In one embodiment the upper corner 61 has a radius R of at least approximately 0.05 inches, and preferably at least about 0.062 inches.

In one embodiment, the blank 3 is formed into the container by conveying a blank in the machine direction MD and placing the blank in the forming tool 9 when the lower tool assembly 152 and upper tool assembly are in a separated or open position. The forming tool 9 is used to press form the blank 3 into the container 5 by moving the tool assemblies 152, 154 together, to a closed position (FIGS. 8 and 9), in a manner such that the punch 153 is pressed against the blank 3 to force the blank into the cavity 164 of the cavity block 151. When the flat blank 3 is pressed into the cavity 154 and formed into the three-dimensional container 5 by closing the forming tool 9, the score lines 17, 19, 37, 39, 47, 49, and 57, 59 facilitate forming the flat blank into the three-dimensional container in the forming tool 9. The score lines 17, 19, 37, 39 47, 49, 57, and 59 allow formation of the marginal portion 15 of the blank 3 into the side wall 137 and flange 7 of the container 5. The flange 7 is formed by being pressed between the nose 153 and the flat upper surface 163 of the cavity block 151. The stiffness of the paperboard material of the blanks 3A, 3B is approximately twice as great in the cross-direction areas as the machine-direction areas. Since the paperboard stiffness is generally weaker in the machine-direction, the blanks 3A, 3B can be subjected to twice the elongation in the machine-direction areas as compared to the cross-direction areas when the blanks 3 are press-formed into the container 5.

In one embodiment of the disclosure, the blank 3C has weakening features that can comprise an increased number of score lines 47, 49 in the cross-direction portions 21, 23 of the marginal area 15 of blank 3C and a decreased spacing A3 between the score lines 47, 49 in the cross-direction areas 21, 23. Also, in one embodiment of the disclosure, the blank 3C has strengthening features that can comprise an increased spacing A4 between the score lines 49 in the machine-direction portions 25, 27. In the illustrated embodiment, each cross-direction area 21, 23 has fourteen first score lines 47 and fifteen second score lines 49, and each machine direction area 25, 27 has fifteen second score lines 49 and zero first score lines 47. Similarly, the blank 3D has weakening features that can comprise an increased number of score lines 57, 59 in the cross-direction portions 81, 83 of the marginal area 15 of the blank 3D and a decreased spacing A5 between the score lines 57, 59 in the cross-direction areas. Further, the blank 3D has strengthening features that can comprise an increased spacing A6 between the score lines 59 in the machine-direction portions 85, 87. The arrangement and positioning of the score lines 47, 49 and 57, 59 in a respective blank 3C, 3D, promotes a uniform width of the flange 7 when the blanks 3C, 3D are formed into the container 5. The stiffness of the blanks 3C, 3D in the cross-direction portions 21, 23, and 81, 83 is reduced by the weakening features that can comprise increased number and closer spacing of the score lines 47, 49, and 57, 59 so that the cross-direction portions will have increased elongation when the blanks are formed into the container 5. The stiffness of the blanks 3C, 3D in the machine-direction portions 25, 27, and 85, 87 is increased as compared to the cross-direction portions 21, 23, and 81, 83, because the strengthening features in the machine direction portions 25, 27, and 85, 87 have a decreased number and larger spacing of the first score lines 49, 59, so that the machine-direction portions will have decreased elongation as compared to the cross-direction portions when the blanks are formed into the container 5.

Also, the radius R of the upper corner 161 of the cavity 151 of the forming tool 9 is increased to minimize the creation of bending forces that will occur when the blanks 3 are formed into the container 5. The forming tool 9 can have other features to facilitate forming of the container 5 from any of the blanks 3A, 3B, 3C, 3D without departing from the scope of this disclosure.

In one aspect, for example, any of the blanks 3A, 3B, 3C, 3D can comprise paperboard having a basis weight of from about 60 to about 330 lbs/ream, (about 27 to about 148 Kg/ream wherein a ream equals 3,000 $ft^2$ or 279 $m^2$), for example, from about 80 to about 140 lbs/ream (about 36 Kg/ream to about 63 Kg/ream). The paperboard generally may have a thickness of from about 6 to about 30 mils, for example, from about 12 to about 28 mils. In one particular example, the paperboard has a thickness of at least about 12 mils. Any suitable paperboard may be used, for example, a solid bleached or solid unbleached sulfate board, such as SUS® board, commercially available from Graphic Packaging International. In another aspect, where a more flexible construct is to be formed, the blank may comprise a paper or paper-based material generally having a basis weight of from about 15 to about 60 lbs/ream (about 6.75 Kg/ream to about 27 Kg/ream), for example, from about 20 to about 40 lbs/ream (about 9 Kg/ream to about 18 Kg/ream). In one particular example, the paper has a basis weight of about 25 lbs/ream (about 11 Kg/ream).

Optionally, one or more portions of the blank or other constructs described herein or contemplated hereby may be coated with varnish, clay, or other materials, either alone or in combination. The coating may then be printed over with product advertising or other information or images. The blanks or other constructs also may be selectively coated and/or printed so that less than the entire surface area of the blank or substantially the entire surface area of the blank may be coated and/or printed.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A blank for forming a container, the blank comprising:

a central portion;

an outer edge; and a marginal portion between the outer edge and the central portion, the blank comprising a radius extending from a center of the blank to the outer edge, the marginal portion comprising a plurality of radial score lines having an angular spacing between respective adjacent radial score lines, the plurality of score lines comprising a plurality of first score lines and a plurality of second score lines, the first score lines each having a respective first length and the second score lines each having a respective second length, the first length being less than the second length, the blank has a machine direction corresponding to the feed direction of the blank into a forming tool and a cross-direction that is perpendicular to the machine direction, the marginal portion has a first cross-direction portion at one cross-directional end of the blank, a second cross-direction portion at a second cross-directional end of the blank, a first machine-direction portion at one machine directional end of the blank, and a second machine-direction portion at a second machine-directional end of the blank, the blank comprises weakening features in each of the first cross-direction portion and the second cross-direction portion for weakening the blank to promote stretching of the blank in the first cross-direction portion and the second cross-direction portion, and strengthening features in each of the first machine-direction portion and the second machine-direction portion for strengthening the blank to resist stretching of the blank in the first machine-direction portion and the second machine-direction portion, the weakening features comprise the plurality of first score lines and at least a portion of the plurality second score lines, the strengthening features comprise at least a portion of the plurality of second score lines, and the strengthening features are free from any of the first score lines in the first machine-direction portion and the second machine-direction portion.

2. The blank of claim 1 wherein in each of the weakening features each of the plurality of first score lines are adjacent to and spaced apart from a respective one of the second score lines by a first angular spacing.

3. The blank of claim 2 wherein each of the second score lines being adjacent to another of the second score lines and being spaced apart from a respective one of the second score line by a second angular spacing, the second angular spacing being greater than the first angular spacing.

4. The blank of claim 1 wherein the first cross-direction portion having the same quantity of first and second score lines as the second cross-direction portion.

5. The blank of claim 4 wherein the first machine-direction portion has the same quantity of second score lines as the second machine-direction portion.

6. The blank of claim 1 wherein the combined quantity of first and second score lines in each of the first and second cross-direction portion is greater than the quantity of second score lines in each machine-direction portion.

7. The blank of claim 1 wherein each of the first score line and the second score line extend from the outer edge of the blank to a location adjacent the central portion of the blank.

8. A container formed from the blank of claim 7, the container comprising:

a bottom wall formed from the central portion;

a side wall extending upwardly from the bottom wall and being formed from at least a portion of the marginal portion of the blank; and a flange extending laterally outward from the side wall and being formed from at least a portion of the marginal portion of the blank.

9. The container of claim 8 wherein bottom panel is generally circular and the container is a tray with the top surface of the flange corresponding to a top surface of the tray.

10. The container of claim 8 further comprising an upper corner that connects the side wall to the flange, the upper being a curved portion of the container that extends between respective flat surfaces of the flange and the side wall.

11. A blank for forming a container, the blank comprising:

a central portion;

an outer edge; and a marginal portion between the outer edge and the central portion, the blank comprising a radius extending from a center of the blank to the outer edge, the marginal portion comprising a plurality of radial score lines having an angular spacing between respective adjacent radial score lines, the plurality of score lines comprising a plurality of first score lines and a plurality of second score lines, the first score lines each having a respective first length and the second score lines each having a respective second length, the first length being less than the second length, the blank has a machine direction corresponding to the feed direction of the blank into a forming tool and a cross-direction that is perpendicular to the machine direction, the marginal portion has a first cross-direction portion at one cross-directional end of the blank, a second cross-direction portion at a second cross-directional end of the blank, a first machine-direction portion at one machine directional end of the blank, and a second machine-direction portion at a second machine-directional end of the blank, the blank comprises weakening features in each of the first cross-direction portion and the second cross-direction portion for weakening the blank to promote stretching of the blank in the first cross-direction portion and the second cross-direction portion, and strengthening features in each of the first machine-direction portion and the second machine-direction portion for strengthening the blank to resist stretching of the blank in the first machine-direction portion and the second machine-direction portion, the weakening features comprise the plurality of first score lines and at least a portion of the plurality second score lines, each of the first score lines being adjacent to and spaced apart from a respective one of the second score lines by a first angular spacing, the strengthening features comprise at least a portion of the plurality of second score lines, each of the second score lines of each of the strengthening features being adjacent to and spaced apart from another of the second score lines by a second angular spacing, the second angular spacing being greater than the first angular spacing.

* * * * *